US007485051B2

(12) United States Patent
Richard, Jr.

(10) Patent No.: US 7,485,051 B2
(45) Date of Patent: Feb. 3, 2009

(54) GOLF PUTTER

(76) Inventor: Joseph K. Richard, Jr., 49 Franklin Rd., Foster, RI (US) 02825

( * ) Notice: Subject to any disclaimer, the term of this patent is extended or adjusted under 35 U.S.C. 154(b) by 0 days.

(21) Appl. No.: 11/589,285

(22) Filed: Oct. 30, 2006

(65) Prior Publication Data

US 2008/0102980 A1 May 1, 2008

(51) Int. Cl.
*A63B 53/04* (2006.01)

(52) U.S. Cl. ..... 473/314; 473/330; 473/340

(58) Field of Classification Search ..... 473/230–341, 473/325, 330–331, 314
See application file for complete search history.

(56) References Cited

U.S. PATENT DOCUMENTS

| | | | | |
|---|---|---|---|---|
| 1,299,014 | A | 4/1919 | O'Hara | |
| 1,511,479 | A | 10/1924 | Kelly et al. | |
| 2,023,885 | A | 12/1935 | Hinckley | |
| 3,394,937 | A | 7/1968 | Allport | |
| 3,625,518 | A | 12/1971 | Solheim | |
| 3,954,270 | A | 5/1976 | Cook | |
| 4,113,249 | A | 9/1978 | Beery | |
| 4,162,074 | A * | 7/1979 | Thomson | 473/330 |
| 4,213,613 | A | 7/1980 | Nygen | |
| 4,326,716 | A | 4/1982 | LaCoste | |
| 4,367,878 | A | 1/1983 | Schmidt | |
| 4,390,184 | A | 6/1983 | Rudell | |
| 4,451,042 | A | 5/1984 | Hayashi et al. | |
| 4,471,961 | A | 9/1984 | Masghati et al. | |
| 4,591,160 | A | 5/1986 | Piragino | |
| 4,614,627 | A | 9/1986 | Curtis et al. | |
| 4,725,062 | A | 2/1988 | Kinney, III | |
| 4,762,322 | A | 8/1988 | Molitor et al. | |
| 4,793,616 | A | 12/1988 | Fernandez | |
| 4,960,279 | A | 10/1990 | Harris, Jr. | |
| 4,984,800 | A | 1/1991 | Hamada | |
| 4,988,104 | A | 1/1991 | Shiotani et al. | |
| 5,007,643 | A | 4/1991 | Okumoto et al. | |
| 5,009,425 | A | 4/1991 | Okumoto et al. | |
| 5,100,146 | A | 3/1992 | Antonious | |
| 5,135,227 | A | 8/1992 | Okumoto et al. | |
| 5,197,737 | A | 3/1993 | Desbiolles et al. | |
| 5,213,332 | A | 5/1993 | Fahy et al. | |
| 5,295,689 | A | 3/1994 | Lundberg | |

(Continued)

FOREIGN PATENT DOCUMENTS

| | | |
|---|---|---|
| WO | WO 99/29374 | 6/1999 |

*Primary Examiner*—Stephen L. Blau
(74) *Attorney, Agent, or Firm*—Nixon Peabody LLP

(57) ABSTRACT

A head on a golf putter is configured to create overspin on a putted golf ball. An exemplary embodiment employs a body with a ball-striking face including a first curved segment with a first radius of curvature and a second curved segment with a second radius of curvature. The first and second curved segments define a curved surface extending from a bottom surface of the body. The first segment is positioned proximate to the bottom surface and the second segment is positioned intermediate the bottom surface and an opposing top surface of the body. The first radius of curvature is greater than the second radius of curvature. The face may have a third curved segment positioned intermediate the second segment and the top surface, with a third radius of curvature greater than the first radius of curvature. The position of the center of mass of the head also promotes overspin.

43 Claims, 10 Drawing Sheets

U.S. PATENT DOCUMENTS 5,303,923 A * 4/1994 Garcia ..... 473/330
5,310,185 A 5/1994 Viollaz et al.
5,333,871 A 8/1994 Wishon
5,340,107 A 8/1994 Baker et al.
5,415,399 A 5/1995 Kettelson
5,415,405 A 5/1995 Vincent
5,437,447 A 8/1995 Rigutto
5,445,382 A 8/1995 Pearce et al.
5,451,056 A 9/1995 Manning
5,465,969 A 11/1995 Cadorniga
5,467,989 A 11/1995 Good et al.
5,511,787 A 4/1996 Baum
5,516,107 A 5/1996 Okumoto et al.
5,542,665 A 8/1996 Levocz et al.
5,570,886 A 11/1996 Rigal et al.
5,577,550 A 11/1996 Schmidt
5,614,143 A 3/1997 Hager
5,665,014 A 9/1997 Sanford et al.
5,669,828 A 9/1997 Schmidt
5,676,605 A 10/1997 Kobayashi
5,681,228 A 10/1997 Mikame et al.
5,683,307 A 11/1997 Rife
5,690,879 A 11/1997 Lee
5,749,790 A 5/1998 Van Alen, II et al.
5,769,735 A 6/1998 Hosokawa
5,772,527 A 6/1998 Liu
5,782,706 A 7/1998 DePriest
5,797,176 A 8/1998 Rose et al.
5,830,078 A 11/1998 McMahan
5,842,935 A 12/1998 Nelson
5,890,969 A * 4/1999 Bechler ..... 473/255
5,924,938 A * 7/1999 Hines ..... 473/307
5,951,412 A * 9/1999 Rose et al. ..... 473/340
6,059,669 A 5/2000 Pearce
6,080,069 A 6/2000 Long
6,086,484 A 7/2000 Uebelhor
6,093,115 A 7/2000 Murtland et al.
6,146,571 A 11/2000 Vincent et al.
6,155,933 A 12/2000 Schmitt
6,176,791 B1 * 1/2001 Wright ..... 473/252
6,273,831 B1 8/2001 Dewanjee
6,302,804 B1 10/2001 Budde
6,319,437 B1 11/2001 Elsner et al.
6,336,869 B1 1/2002 Hettinger et al.
6,344,002 B1 2/2002 Kajita
6,375,583 B1 4/2002 Solheim
6,386,991 B1 5/2002 Reyes et al.
6,390,932 B1 5/2002 Kosmatka et al.
6,402,639 B1 6/2002 Iwata et al.
6,428,426 B1 8/2002 Helmstetter et al.
6,454,664 B1 9/2002 Long et al.
6,458,043 B1 10/2002 McCabe et al.
6,485,375 B1 * 11/2002 McKinley ..... 473/245
6,569,032 B1 * 5/2003 Haliyo ..... 473/313
6,582,322 B2 6/2003 Long et al.
6,595,869 B2 7/2003 McCabe et al.
6,638,181 B1 10/2003 Norman, III
6,692,378 B2 2/2004 Shmoldas et al.
6,716,110 B1 * 4/2004 Ballow ..... 473/242
6,729,971 B2 5/2004 Caldwell
6,899,637 B2 5/2005 Caldwell
6,942,581 B2 9/2005 Kim et al.
6,951,517 B2 10/2005 Lindsay
6,966,847 B2 11/2005 Lenhof et al.
6,979,269 B1 12/2005 Nohara
7,294,066 B1 11/2007 Richard, Jr.
2002/0049093 A1 4/2002 Reyes et al.
2002/0065144 A1 5/2002 Helmstetter et al.
2003/0008724 A1 1/2003 Griffin
2003/0134688 A1 7/2003 Rice
2003/0211901 A1 11/2003 Day
2003/0228926 A1 12/2003 Wang
2003/0236130 A1 12/2003 Gammon, Jr.
2004/0229712 A1 11/2004 Jackson
2004/0254030 A1 12/2004 Nishitani et al.
2005/0137027 A1 6/2005 Thomas
2005/0221908 A1 10/2005 Gornall
2005/0233826 A1 10/2005 Vesligaj
2005/0255930 A1 11/2005 Johnson
2005/0255937 A1 11/2005 Stackpole
2006/0014591 A1 1/2006 Engdahl
2006/0030423 A1 2/2006 Lindsay
2006/0035718 A1 2/2006 Soracco et al.
2006/0172816 A1 * 8/2006 Johnson ..... 473/334

* cited by examiner

GOLF PUTTER

BACKGROUND OF THE INVENTION

1. Field of the Invention

The present invention is directed to golf clubs, and more particularly to a golf putter.

2. Description of Related Art

The popularity of golf has created a strong demand for golf equipment and other related products and services. Many golf players are willing to spend significant time and money to develop their skills and improve their level of play. As a result, equipment makers continue to research and develop new golf club designs to attract these consumers.

One area of this research and development focuses on the design of putters. In particular, many different types of putter features have been developed for aiming, sighting, and alignment of the putter with the object of ensuring that the golf ball travels in the desired direction when putted. Indeed, the United States Golf Association (USGA) requires that all clubheads "be generally plain in shape," but this "plain in shape" rule is interpreted liberally for putters and an extensive list of exceptions exists for putters. Given the broad range of permissible designs for putters, makers have incorporated many different features into putter designs.

Despite the ongoing attempts to improve putting accuracy with such features, most putters continue to suffer from common problems and disadvantages. Generally, when most putters strike the golf ball, they create a backspin on the ball. The golf ball is usually situated within a slight depression in the ground, and is lifted out of the depression when struck. The ball may become airborne for a distance, and eventually hits the ground with the backspin. Although the ball is propelled forward by the initial contact with the putter face, it loses momentum with the backspin. In addition, the ball tends to skid with the backspin and may not follow the intended line to the hole. Thus, even if the ball originally follows the desired line at initial contact, backspin on the ball introduces inaccuracies by causing the ball to skid and stray from the desired line. Further inaccuracies may also result when the ball bounces after becoming airborne.

SUMMARY OF THE INVENTION

In view of the foregoing, a need exists for a putter that minimizes the creation of backspin on the golf ball and reduces the associated inaccuracies. Accordingly, the present invention provides a putter with a putter head that creates overspin, or forward topspin, rather than backspin. As a result, when a golf ball is struck by a putter according to the present invention, the golf ball maintains the momentum it receives when initially struck by the putter. Moreover, a putter according to the present invention reduces the likelihood that the golf ball will become airborne and leave the putting surface. Thus, the present invention minimizes skidding or bouncing by the golf ball and keeps it from straying from the desired putting direction.

In an exemplary embodiment of the present invention, the body of the putter head has a ball-striking face including a first curved segment with a first radius of curvature and a second curved segment with a second radius of curvature. The first and second curved segments define a curved surface extending from a bottom surface of the body. The first segment is positioned proximate to the bottom surface and the second segment is positioned intermediate the bottom surface and an opposing top surface of the body. The first radius of curvature is greater than the second radius of curvature. In an alternative embodiment, the ball-striking face above may have a third curved segment with a third radius of curvature. The first, second, and third curved segments define a curved surface extending from the bottom surface of the body to the top surface of the body. The third segment is positioned intermediate the second segment and the top surface, and the third radius of curvature is greater than the first radius of curvature. In general, the radii of curvature give the ball-striking face a profile that promotes the creation of overspin on the golf ball.

In a further exemplary embodiment, a golf putter head includes a ball-striking face having at least two curved segments defining a curved surface from a top surface of the putter head to an opposing bottom surface of the putter head, where the curved segments have different radii of curvature. The putter head also has a rear portion extending from the ball-striking face to a rear end of the putter head opposite the ball-striking face, where the rear portion has greater mass closer to the rear end of the putter head than the ball-striking face. The center of mass of the putter head may also be positioned closer to the top surface of the putter head than the bottom surface. In general, the distribution of mass in the putter head creates a center of mass that creates a tendency for the putter head to brush upwards against the golf ball to create overspin.

In yet another exemplary embodiment, a golf putter head includes a shell of a first material having a shell cavity and a filler of a second material positioned in the shell cavity. The shell has a ball-striking face with at least two curved segments defining a curved surface from a top surface of the head to an opposing bottom surface of the head, where the curved segments have different radii of curvature. The golf putter head may optionally employ an outer cover of a third material. The shell is configured to create a center of mass that is closer to the rear end and creates a tendency for the putter head to brush upwards against the golf ball to create overspin.

These and other aspects of the present invention will become more apparent from the following detailed description of the preferred embodiments of the present invention when viewed in conjunction with the accompanying drawings.

DETAILED DESCRIPTION

Figure 1:
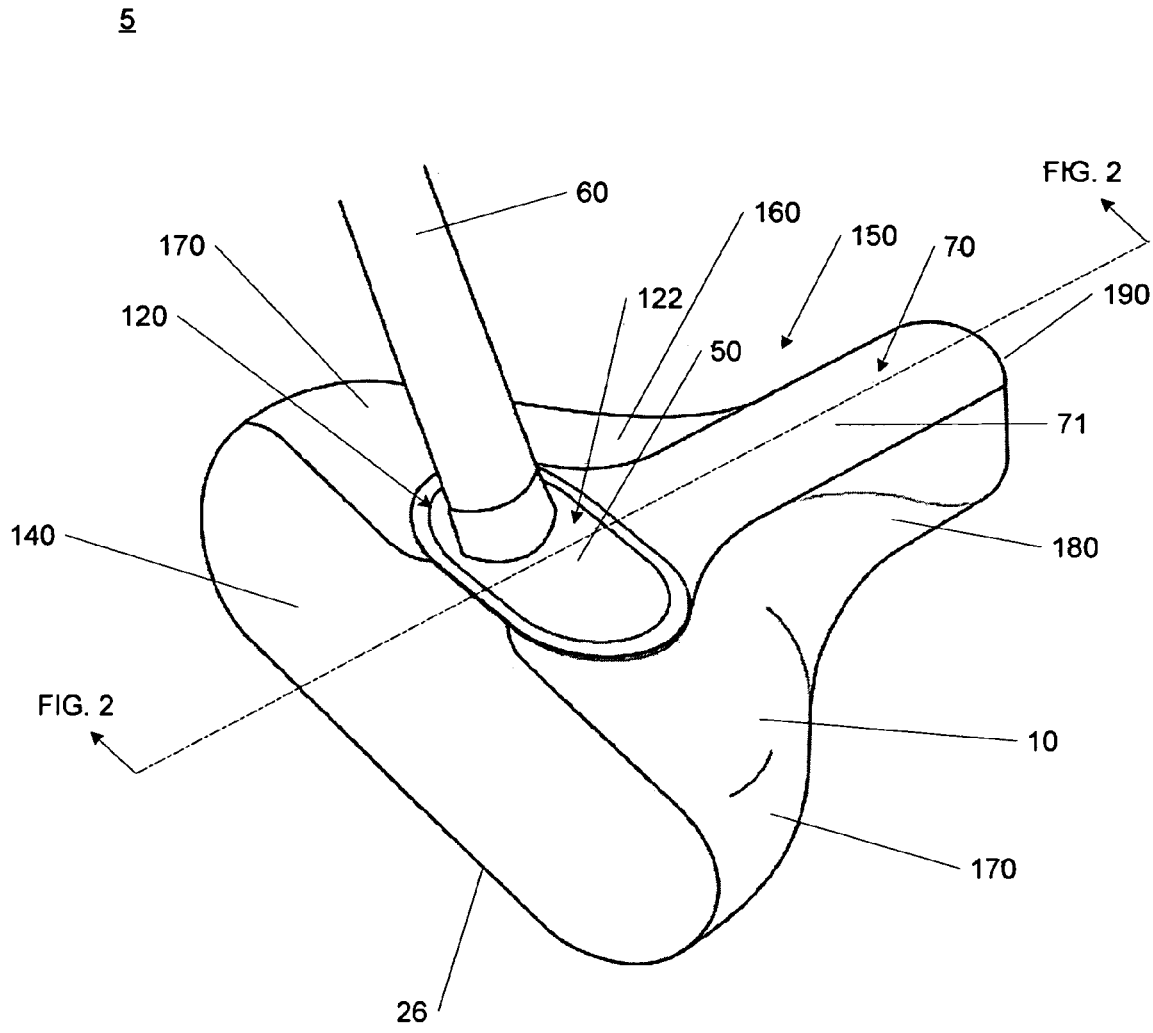
FIG. 1 illustrates a perspective view of an exemplary golf putter with features of the present invention.

Illustrating an exemplary embodiment of the present invention, FIG. 1 shows a golf putter 5 that has a putter head 10 connected to a shaft 60. The assembled golf putter 5 may be used in a manner in which any putter is generally used in golf. Accordingly, the golf putter 5 may be used in a variety of putting situations, from "on the green" putting to "off the green" putting.

Referring to the embodiment of FIG. 1, the putter head 10 has a hosel cavity 120 for receiving a hosel 50, which in turn receives the shaft 60 of the putter to connect the shaft 60 with the putter head 10. On the other end of the shaft 60 is a grip or handle (not shown), which a golfer uses to swing the putter 5. The putter head 10 has a front ball-striking face 140 for making contact with a golf ball.

The shape of the putter head 10 of putter 5 is generally defined by the front, or ball-striking, face 140 and a rear portion 150 extending from the front face 140. The rear portion 150 has two shoulders 170, the hosel cavity 120, and an end body 180 that defines a rear end 190. In addition, the top surface 160 has an alignment system 70 formed by a marking 71 that is positioned around an opening 122 of the hosel cavity 120 and along the end body 180.

Figure 2:
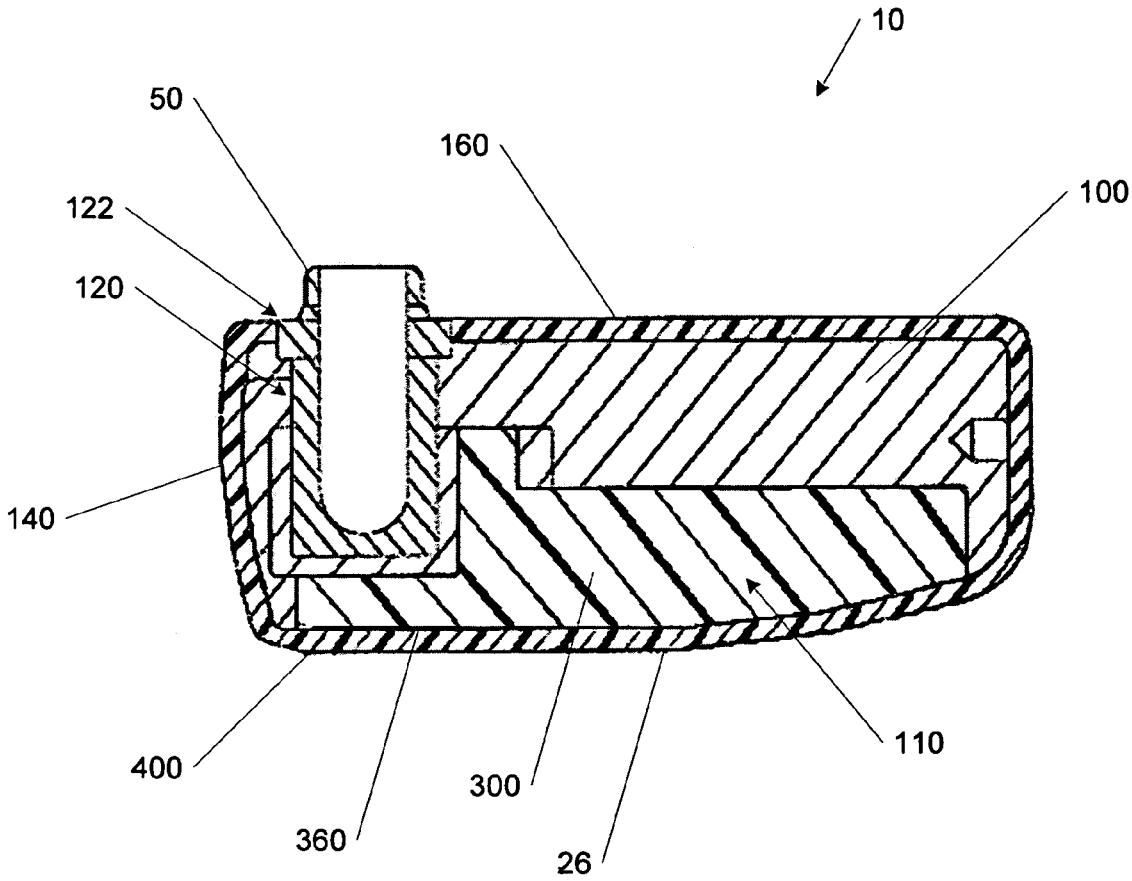
FIG. 2 illustrates a cross sectional view of the putter head for the exemplary golf putter illustrated in FIG. 1.
Figure 3:
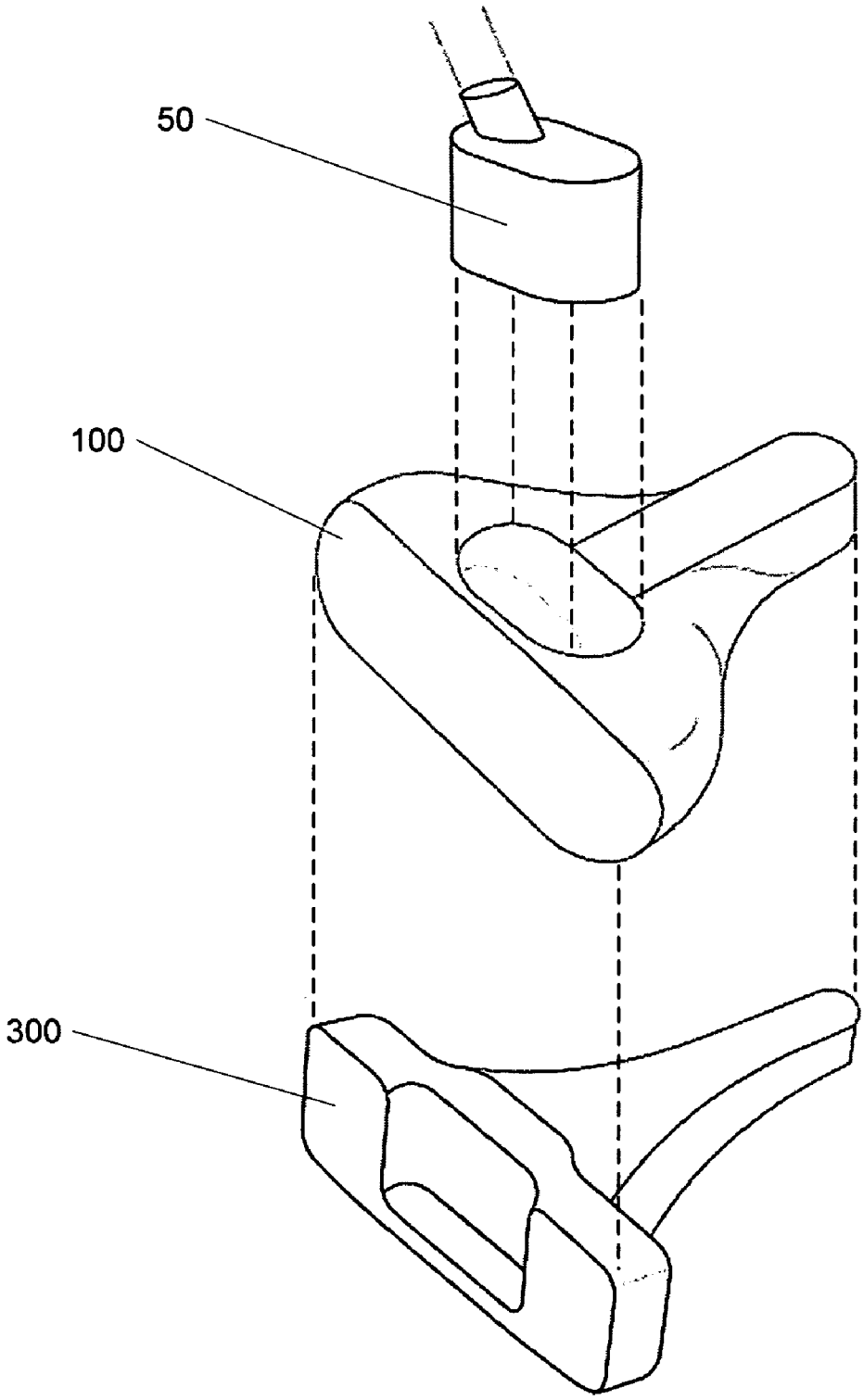
FIG. 3 illustrates an exploded perspective view of the putter head for the exemplary golf putter illustrated in FIG. 1.

The cross-sections shown in FIG. 2 further illustrate details of the putter head 10. The putter head 10 is formed from a shell 100 that has at least one shell cavity 110 filled with filler 300. FIG. 3 provides an exploded view of the hosel 50, the shell 100, and the filler 300.

Figure 4A:
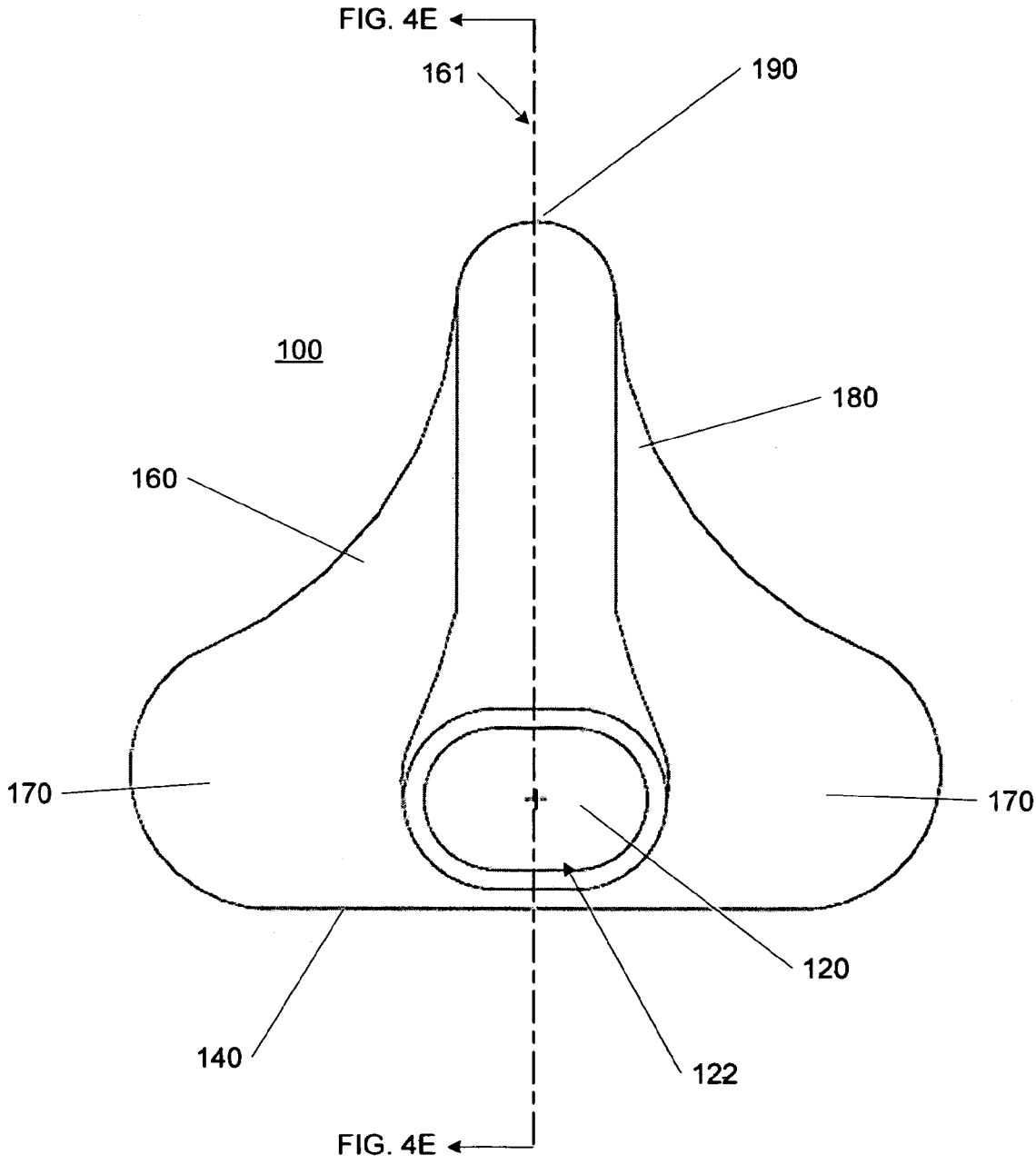
FIG. 4A illustrates a view of the top surface of the shell of the exemplary golf putter illustrated in FIG. 1.

The details of the shell 100 are shown in FIGS. 4A-E. FIG. 4A provides a view of the top surface 160. The shell 100 is substantially symmetric about a top centerline 161. The shell 100 includes the ball-striking face 140, the two shoulders 170, the hosel cavity 120, and the end body 180.

The hosel cavity 120 is positioned proximate to the ball-striking surface 140. The hosel cavity 120 lies along the top centerline 161. The end body 180 is generally elongated and extends from hosel cavity 120 to define the rear end 190. The end body 180 also lies symmetrically along the top centerline 161.

The shoulders 170 are positioned on either side of the hosel cavity 120. The shell shoulders 170 start at the front surface 140 and extend toward the rear end 190. The width of the top surface 160 is at least as wide the front surface 140, but gradually becomes narrower toward the rear end 190 in a contoured manner. (The width refers to the dimension along a line substantially transverse to the top centerline 161 shown in FIG. 4A.) As a result, the curved shoulders 170, in combination, define the top surface 160 which generally tapers from a larger dimension at the front surface 140 to a smaller dimension at the rear end 190. The front surface 140 is wider than the rear end 190. Moreover, as shown in FIG. 4A, the rear end 190 may be curved so that the top surface 160 has an overall contoured shape.

As further illustrated in FIG. 4A, the top surface 160 has a hosel opening 122 for hosel cavity 120. The hosel opening 122 is also symmetric about top centerline 161. The hosel opening 122 is shaped to receive the hosel 50. In particular, the hosel opening 122 has a shape that ensures proper orientation of the hosel 50 when inserted into the hosel cavity 120. For example, the shell hosel opening 122 may be oblong. The hosel cavity 120 and the hosel 50 are described in further detail hereinbelow.

In a particular embodiment, the ball-striking face 140 forms an edge for the top surface 140 that is about 2.7 inches in width. The shoulders 170 extend from the ball-striking face 140 and define a maximum width of about 3.8 inches for the top surface 160. From this maximum width, the shoulders 170 extend further from the ball-striking face 140, but the outer boundaries of the shoulders 170 curve toward the centerline 161 until they meet the end body 180. The combination of the shoulders 170 narrow until their outer boundaries intersect the end body 180. The oblong hosel opening 122 on the top surface 160 is about 1.1 inches in width and about 0.7 inches along the top centerline 161. The center of the hosel opening 122 is about 0.55 inches from the front surface 140. Extending from the hosel cavity 120 to the rear end 190 along the top surface 160, the end body 180 is approximately 2.3 inches along the top centerline 161. The end body has a width of approximately 0.75 inches on the top surface 160. It is understood, however, that any and all dimensions described herein are purely exemplary and are presented merely to facilitate understanding of the present invention. The present invention is not limited to any specific dimensions.

Figure 4B:
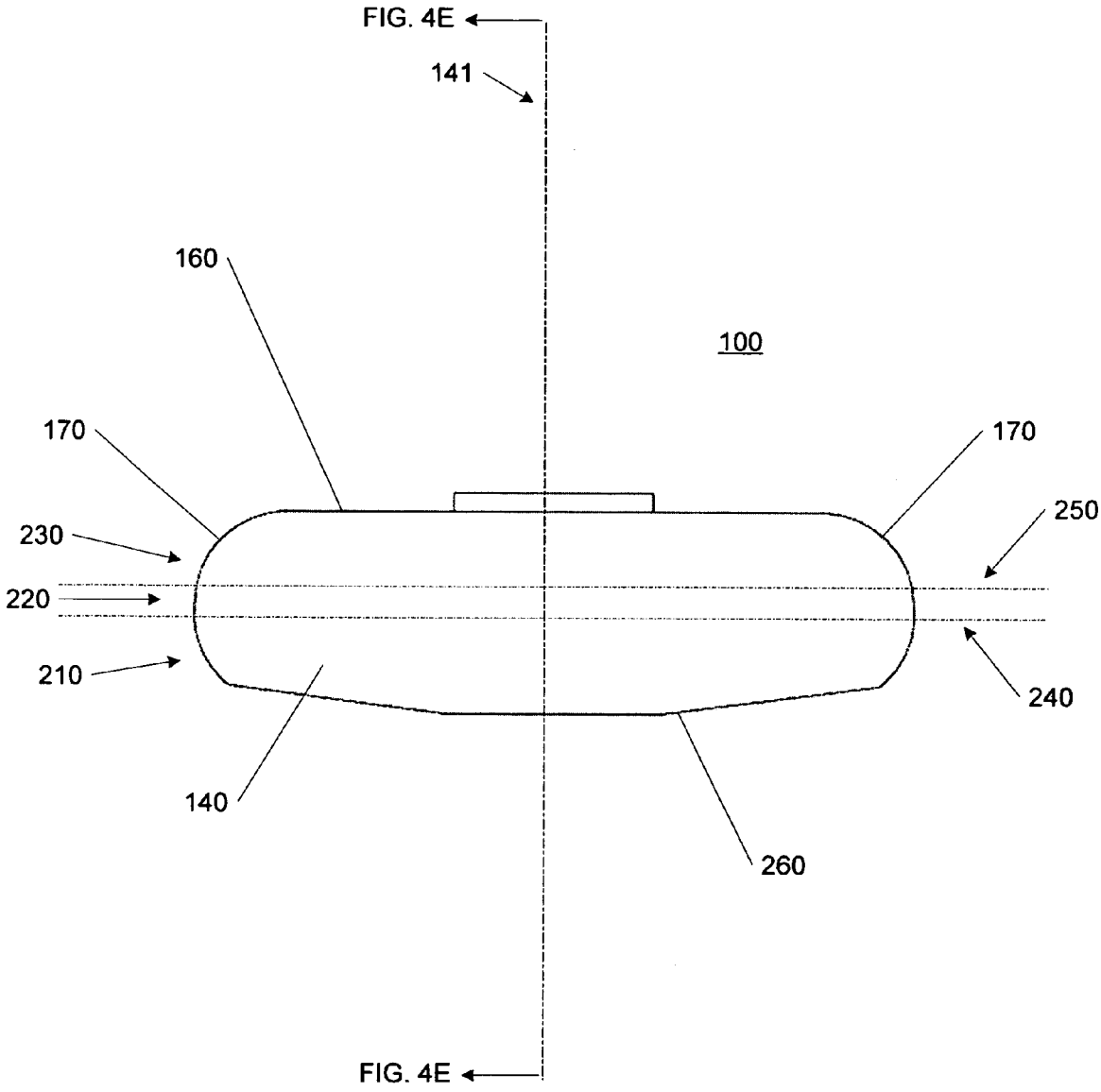
FIG. 4B illustrates a view of the front surface of the shell of the exemplary golf putter illustrated in FIG. 1.

As illustrated in FIG. 4B, the ball-striking face 140 is generally symmetric about a front centerline 141. The front centerline 141 intersects with the top centerline 161 of the top surface 160 shown in FIG. 4A. The ball-striking face 140 is bounded by the top surface 160 and a bottom 260 of the shell 100. As shown on FIG. 4B, the boundary between the ball-striking face 140 and the shell bottom 260 angles upward as the boundary extends toward the two sides of the ball-striking face 140. In addition, the ball-striking face 140 extends on both sides to the shoulders 170. The shoulders 170 generally, curve from the top surface 160 to the shell bottom 260.

In a particular embodiment, the width of the ball-striking face 140 is approximately 2.7 inches, as indicated above. In addition, from the top surface 160 to the shell bottom 260, the ball-striking face 140 is about 1.2 inches at the centerline 141 and decreases to about 1.0 inches on the sides.

Figure 4C:
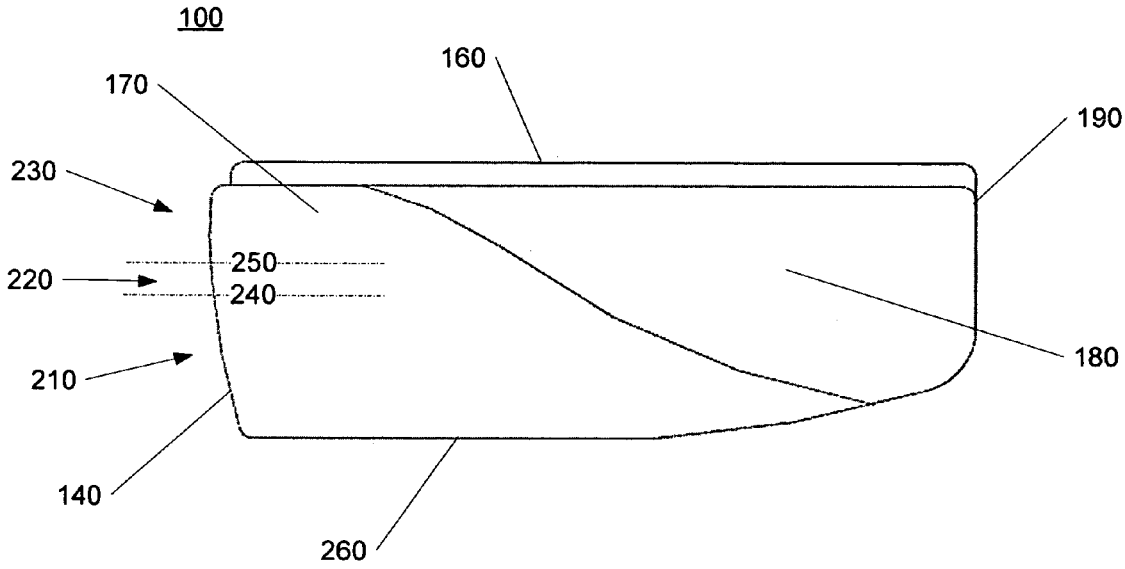
FIG. 4C illustrates a view of the side surface of the shell of the exemplary golf putter illustrated in FIG. 1.

FIG. 4C illustrates a side view of the shell 100. As mentioned previously, the shoulders 170 extend from the ball-striking face 140 toward the rear end 190. The height of a shoulder 170 measured from the shell bottom 260 is approximately equal to the ball-striking face 140, but decreases as it extends away from the ball-striking face 140. (The height refers to the dimension along a line substantially parallel to the front centerline 141 shown in FIG. 4B.) In other words, the top surface of the shoulder 170 curves toward shell bottom 260 to create a shape tapering to a smaller dimension. On the other hand, the end body 180 is substantially planar at the top surface 160.

FIG. 4C also shows that the shell bottom 260 has three sections from the ball-striking face 140 to the rear end 190. As the shell bottom 260 extends away from the ball-striking face 140, the shell bottom 260 angles away from the top surface 160. At an intermediate portion of the shell bottom 260, the shell bottom 160 is substantially parallel to the top of the end body 180. However, as the shell bottom 260 extends further from the ball-striking face 140, it curves gradually toward the top surface 160 as the shell 100 extends to the rear end 190. Thus, the height of the end body 180 also tapers to a smaller dimension as it approaches the rear end 190.

In a particular embodiment, the height of the shoulder 170 is about 1.1 inches at the ball-striking face 140, but tapers to zero inches near the rear end 190. Meanwhile, the end body 180 is about 1.2 inches proximate to the hosel cavity 120, but tapers to about 0.80 inches at the rear end 190.

As FIG. 4C further illustrates, the ball-striking face 140 has three curved segments 210, 220, and 230 defining a larger curve from the bottom side 260 to the opposing top surface 160. The curved segments 210, 220, and 230 are also illustrated in FIG. 4B. The first curved segment 210 is a section of the ball-striking face 140 between the bottom side 260 and a first intermediate boundary 240, which extends across the ball-striking face 140 generally transverse to the front centerline 141. The second curved segment 220 is a section between the first intermediate boundary 240 and a second intermediate boundary 250. The second intermediate boundary 250 also extends across the ball-striking face 140 generally transverse to the front centerline 141, and is positioned farther from the bottom side 260 than the first intermediate boundary 240. The third curved segment 230 is a section between the second intermediate boundary 250 and the top surface 160.

Figure 5:
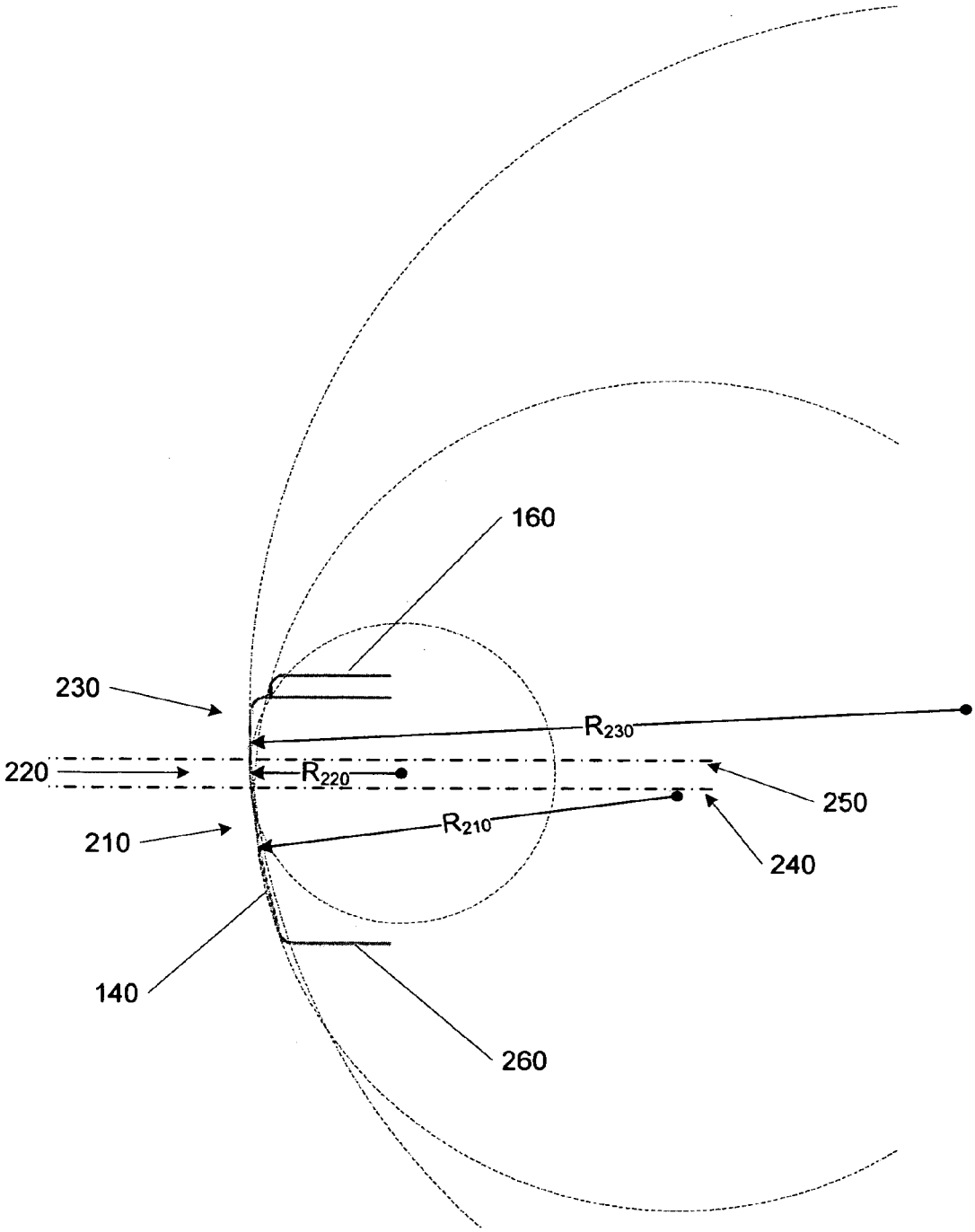
FIG. 5 illustrates a side view showing the radii of curvature of the segments making up the front surface of the shell of the exemplary golf putter illustrated in FIG. 1.

As shown in FIG. 5, the curved segments 210, 220, and 230 have different radii of curvature $R_{210}$, $R_{220}$, and $R_{230}$, also known as roll radii. The radius $R_{210}$ defines the curvature of the first curved segment 210 as it extends between the bottom side 260 and the first intermediate boundary 240. The radius $R_{220}$ defines the curvature of the second curved segment 220 as it extends from the first intermediate boundary 240 to the second intermediate boundary 250. The radius $R_{230}$ defines the curvature of the third curved segment 230 as it extends from the second intermediate boundary 250 to the top surface 160. The first intermediate boundary 240 is preferably positioned about 0.8 inches from the bottom side 260, and the second intermediate boundary 250 is preferably positioned about 1.15 inches from the bottom side 260.

Preferably, the radius $R_{210}$ is greater than radius $R_{220}$, while radius $R_{230}$ is greater than radius $R_{210}$, i.e. $R_{230}>R_{210}>R_{220}$. For example, the radius $R_{210}$ may be equal to approximately 3.0 inches, the radius $R_{220}$ may be equal to about 1.75 inches, and the radius $R_{230}$ may be equal to approximately 7 inches, where the ratio $R_{210}:R_{220}:R_{230}$ is about 1:0.6:2.3. With $R_{230}>R_{210}>R_{220}$, the smaller radius $R_{220}$ of the second curved segment 220 causes the profile of the front surface 140 to have a protrusion. That is, the second curved segment 220 protrudes slightly in relation to the first curved segment 210 and the third curved segment 230. Moreover, the side profile of the ball-striking face 140, as seen in FIG. 4C, generally angles away from the rest of the shell 100 as it extends from the bottom side 260. In other words, the angle between the ball-striking face 140 and the bottom side 260 is greater than 90 degrees, and the ball-striking face 140 is angled toward the putting surface, or the ground on which the golf ball is situated.

Advantageously, the radii of curvature $R_{210}$, $R_{220}$, and $R_{230}$ enable the putter head 10 to impart an overspin, or forward topspin, on the golf ball during putting. During a conventional putting stroke, the putter 5 swings in a pendulum motion and strikes the golf ball with the ball-striking face 140 of the putter head 10. Preferably, the first intermediate boundary 240 is positioned such that the front face 140, during a conventional swing, initially makes contact with the golf ball in the region of the first intermediate boundary 240. For instance, the first intermediate boundary 240 may be positioned 0.8 inches from the bottom surface 260. Because the second curved segment 220 protrudes above the first intermediate boundary 240 and is angled forward with respect to the first curved segment 210, the second curved segment 220, just above the first intermediate boundary 240, makes first contact with the ball when golfer swings the putter head 10 along a conventional path slightly above the putting surface. The second curved segment 220 contacts the upper surface of the golf ball with a force in the direction of the stroke, causing the ball to roll forward with overspin. In addition, contact with the relatively small area of the second curved segment 220, just above the first intermediate boundary 240, minimizes the number of forces acting in multiple directions that might be caused by contact with more surface area.

Furthermore, because the radii of curvature $R_{210}$, $R_{220}$, and $R_{230}$ angle the ball-striking face 140 toward the ground, the front face 140, upon contact, drives the golf ball downward toward the ground in addition to propelling it forward. In particular, the protruding second curved section 220, just above the first intermediate boundary 240, also causes the ball to be driven downward. Moreover, the pendulum motion of the putter 5 itself promotes the effect of driving the golf ball downward, because the pendulum motion naturally causes the ball-striking face 140 to be angled slightly further toward the ground as it makes contact with the ball.

By driving the golf ball downward against the ground, the putter head 10 promotes contact between the ground and the golf ball. The resulting friction between the ground and the ball resists the creation of backspin. The friction from the ground acts on the lower part of the ball against the direction of the stroke, causing the ball to obtain an overspin.

After initial contact is made near the first intermediate boundary 240, the putter 5 continues its swing through the bottom of the pendulum. Maintaining contact with the golf ball, the front face 140 continues forward and upward, causing the first curved section 210 to move into contact with the ball. In other words, when initial contact is made; the first curved section 210 is angled away from the ball, but the subsequent pendulum movement of the putter 5 causes the first curved section 210 to move, or roll, into contact with the ball. The first curved section 210 creates additional overspin as it brushes upward on the golf ball. To further promote the creation of overspin, the ball-striking surface 140 of the putter head 10 may be textured to increase the frictional contact between the ball-striking surface 140 and the ball.

Before the golf ball is struck by the putter head 10, the ball is generally positioned within a slight depression on the putting surface. Therefore, the present invention drives the golf ball into the depression to create the overspin, whereas conventional putters create backspin as the golf ball climbs out of the depression. Furthermore, with conventional putters, the ball is lifted out of the depression and may become airborne. By putting a downward force and creating an overspin on the golf ball, the present invention, however, reduces the likelihood that the golf ball will become airborne and minimizes any skidding or bouncing that may occur when it lands.

Thus, according to the foregoing description, the present invention minimizes the inaccuracies introduced by skidding or bouncing and preserves the momentum of the golf ball by creating overspin and keeping the ball on the putting surface.

Although the embodiment described previously employs the three curved segments 210, 220, and 230, a similar, but alternative, embodiment may employ just the first and second curved segments 210 and 220, where the second curved segment 220 extends from the first intermediate boundary 240 to the top surface 160. In this alternative embodiment, the radius of curvature $R_{210}$ for the first curved segment 210 is also greater than the radius of curvature $R_{220}$ for the second curved segment 220.

Figure 4D:
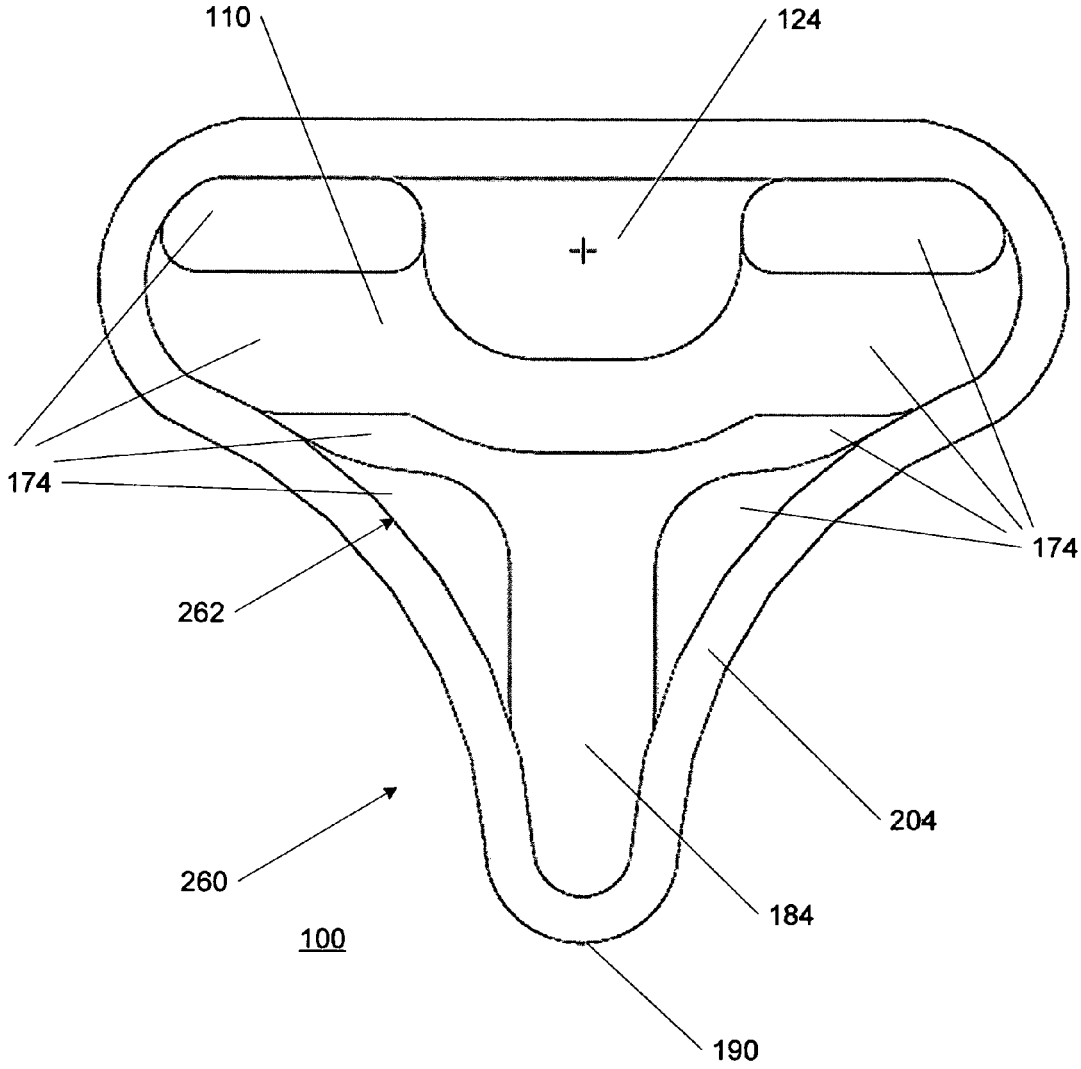
FIG. 4D illustrates a view of the bottom side of the shell of the exemplary golf putter illustrated in FIG. 1.

FIG. 4D illustrates the bottom side 260 of the shell 100 which includes an opening 262 to the shell cavity 110. The opening 262 is defined by the shell wall 204 extending from the top surface 160. As an example, the wall 204 has a thickness of approximately 0.2 inches. The shape of the opening 262 is similar to the shape of the top shell top surface 160 shown in FIG. 4A. The only surface area for the bottom side 260 is created by the relatively thin wall 204. Thus, in the exemplary embodiment of FIG. 4D, the shell bottom 260 has no bottom wall enclosing any part of the shell cavity 110. It is understood, however, some portion of the shell bottom 260 may include a bottom wall that encloses a portion of the shell cavity 110.

As further shown in FIG. 4D, the shell cavity 110 generally has Y-shape defined in part by a wall 124 forming the hosel cavity 120, a wall 184 formed by the end body 180, and walls 174 formed by the shoulders 170. The walls 124, 184, and 174 extend from the top surface 160 but do not extend all the way to the bottom side 260. As described further below, the walls 124, 174, and 184 are configured, or arranged, to position the center of mass of the putter head 10.

Figure 4E:
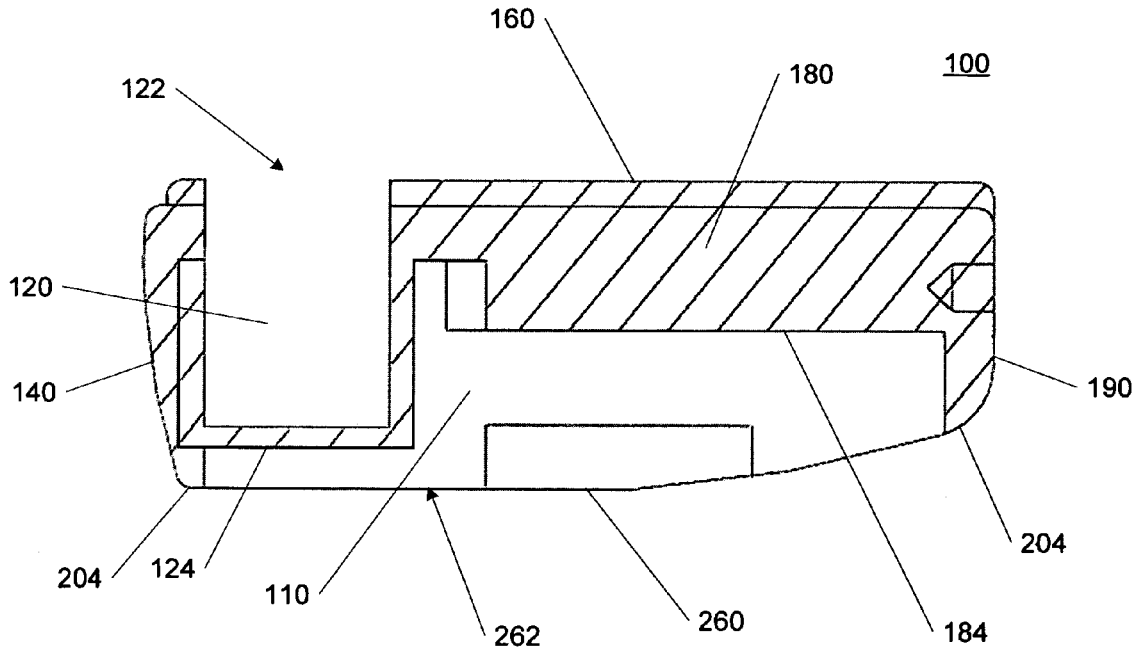
FIG. 4E illustrates a cross-sectional view of the shell of the exemplary golf putter illustrated in FIG. 1.

FIG. 4E provides a cross-sectional view along the plane containing the centerlines 161 and 141 shown in FIGS. 4A and 4B. As FIG. 4E illustrates, the hosel cavity 120 is formed by a wall 124 which extends downwardly from the top surface 160 into the shell cavity 110. The shoulders 170 also extend downwardly into the shell cavity 110 from the top surface 160 to form the walls 174. The thickness of the walls 174 of the shoulders 170 generally increases in stepwise fashion as the shoulders 170 extend away from the ball-striking surface. 140. In addition, the end body 180 extends downwardly into the shell cavity 110 from the top surface 160 to form the wall 184. The thickness of the wall 184 is greater than the thickness of walls 174. In general, the wall of the shell 100 is thickest proximate to the portion of the shell 100 where the top surface 160 and the rear end 190 are adjacent.

Moreover, as described previously, the shoulders 170 taper to a smaller dimension when seen from the top view of FIG. 4A and the side view of FIG. 4B. Because the shoulders 170 taper to a smaller dimension as they extend toward the rear end 190, the volume of the shell cavity 110 defined by the shoulders 170 also reduces as the shoulders 170 extend toward the rear end 190. Accordingly, as shown in FIGS. 4D and 4E, the shell cavity 110 has a proportionally greater volume closer to the ball-striking surface 140 than the rear end 190. Although the FIGS. 4D and 4E show a contiguous shell cavity 110 with a Y-shape, it is understood that additional structures and walls may be employed within the shell cavity 110 and that more than one cavity can be formed by these structures and walls.

In a particular embodiment, the hosel cavity 120 extends about one inch from the top surface 160 and about 0.87 inches from the shell front surface 140. The end body 180 extends about 0.6 inches from the top surface 160 for a length of about two inches from the rear end 190. The shoulders 170 extend about 0.1 inches near the shell front surface 140 to about 0.28 inches closer to the rear end 190.

The shell 100 may be made of a metal containing zinc, aluminum, titanium, or steel, but is not limited to these particular materials. As such, the mass of the shell 100 is preferably 250 grams to 300 grams. The shell 100 may be formed by a variety of known manufacturing techniques including, but not limited to, casting or machining, or any combination thereof. Preferably, the shoulder 170, the hosel cavity 120, and the end body 180 are integrally formed to produce the shell 100. However, it is understood that the shell 100 may be formed by separately manufactured components that are subsequently assembled together.

As shown in FIG. 2, shell cavity 110 is filled with a filler 300. The filler 300 is made of a filler material that has a lower density than the shell material making up the shell 100. For example, the filler 300 may be a plastic with a density of about 1.0 grams/cm$^3$, whereas the shell 100 may be formed from a zinc alloy with a density of about 7.0 grams/cm$^3$. To fill the entire shell cavity 110, the filler 300 may be molded into the shell cavity 110. However, the filler 300 may be manufactured according to other known methods and subsequently inserted into the shell cavity 110 as a separate component. Although the filler 300 preferably fills the entire shell cavity 110, other embodiments of the present invention may have hollow sections within the shell cavity 110. Moreover, the filler 300 may be formed from more than one material.

As indicated previously with respect to the embodiment shown in FIG. 4D, the shell bottom 260 has no bottom wall enclosing any part of the shell cavity 110. Thus, the filler 300 forms a bottom surface 360 shown in FIG. 2 which makes up substantial portion of the bottom surface of the combination of the shell 100 and the filler 300. Furthermore, the front and side views of the bottom side 260 of the shell 100 illustrated in FIGS. 4B and 4C, respectively, indicate that the bottom surface 360 is not planar. In other words, the bottom surface 360 is beveled or curved upwards at the edges.

The combined shape of the shell bottom 260 and the bottom surface 360 make up the putter bottom 26. Advantageously, the shape of the filler 300 permits grass or other plants in the path of the swinging putter head 10 to move easily under the putter bottom 26, particularly along the sides, thus reducing any resistance to the movement of the putter head 10. The beveled sides also reduce contact with obstructions, such as small pebbles, that may also lie in the path of the putter head 10. In general, the beveled surfaces create a smaller surface area at the very bottom of the putter head 10, minimizing the amount of possible contact with any part of the ground and any resistance which may alter the path of the putter head 10. Furthermore, the curved section of the bottom surface proximate to the rear end 190 allows the putter head 10 to swing in a pendulum motion just above the ground, without causing contact between the ground and the putter bottom 26 proximate to the rear end 190.

As also shown in FIG. 2, the putter head 10 may have an optional outer cover 400 that covers the combination of the shell 100 and the filler 300. The outer cover 400 may define the entire outer surface of the putter head 10, or a portion thereof. For example, the outer cover 400 may cover the entire outer surface with the exception of the front surface 140 of the shell 100. The outer cover may be made of a plastic with a density that is less than the material making up the shell 100, but may be greater than the density of the filler 300. For example, the outer cover may have a density of about 1.25 grams/cm$^3$, where a zinc shell 100 may be about 7.0 grams/cm$^3$ and the filler 300 may be about 1.0 grams/cm$^3$. In a particular embodiment the outer over 400 has a Shore D hardness of about 60 D to provide desired characteristics, e.g. energy transfer and feel, when the ball-striking surface 140 strikes the ball.

The outer cover 400 may be molded over the combination of the shell 100 and the filler 300. The thickness of the outer cover may range from about 1/16 inch to 1/8 inch. If the outer cover 400 is molded over the front surface 140 of the shell 100, the thickness of the outer cover 400 increases the radii of curvature $R_{210}$, $R_{220}$, and $R_{230}$ defined by the shell 100 to $R_{210}'$, $R_{220}'$, and $R_{230}'$, while preserving the profile defined by the shell 100.

As indicated above, the ball-striking surface 140 may be textured to improve the frictional contact between the ball-striking face 140 and the ball. Correspondingly, the outer cover 400 is textured at the ball-striking face 140.

Although the embodiments discussed above may include an outer cover 400, the outer cover 400 is optional. As such, the combination of the shell 100 and the filler 300, without an outer cover, may make up the assembled putter head 10. It is understood however, that some parts of the outer surface may be painted for aesthetic purposes. With no outer cover 400, the front surface 140 is textured to provide the appropriate frictional characteristics to create overspin when the front surface 140 contacts the ball.

In general, the assembled putter head 10 has a mass that ranges from 360 to 425 grams, and preferably has a mass of about 375 grams. Because the filler 300 has a lower density than the shell 100, the shell 100 is a greater factor than the filler 300 in determining how the mass of putter head 10 is distributed.

As discussed previously, the shell cavity 110 is generally defined by a wall that extends downward from the top surface 160 and by an opening 202 along the bottom side 260. In addition, the thickness of the wall extending downward from the top surface 160 is generally thicker closer to the shell rear end 190. Furthermore, the shell cavity 110 has a proportionally larger volume closer to the front surface 140 than the shell rear end 190. Accordingly, the putter head 10 has greater mass closer to the rear end 190 and closer to the top surface 160. In general, the center of mass of the putter head 10 is closer to the rear end 190 and the top surface 160 than the front face 140 and the putter bottom 26, respectively.

Although the position of the center of mass for the exemplary embodiments above is determined in large part by the distribution of mass of the shell 100 and the filler 300, alternative embodiments of the present invention may employ separate weights which are positioned within the shell cavity 110 or on the shell 100 to produce the desired center of mass. Furthermore, embodiments of the present invention may employ a mechanism by which different weights can be interchangeably positioned in or on the putter head 10 to suit the preferences of the individual golfer.

Advantageously, the distribution of mass for the putter head 10 promotes the creation of overspin on the ball when the ball-striking surface strikes the ball. As described above, in a conventional putter swing, the ball-striking face 140 is angled toward the ground when the ball-striking face 140 initially contacts the ball. During this initial contact, the weight of the putter head 10 drives the ball toward the ground to create overspin in the manner described above. The position of the center of mass is closer to the top surface 160 than the putter bottom 26 to promote the downward force on the ball during the putter swing.

Furthermore, as the putter head 10 proceeds through the swing, gravity creates a torque about the hosel 50 proximate to the ball-striking face 140, because the center of mass is positioned closer to the rear end 190 than the ball-striking face 140 and is rearward of the hosel 50 and the shaft 60. In other words, a resulting downward force behind the hosel 50 tends to push the rear end 190 down and the ball-striking face 140 upward. The upward motion of the ball-striking face 140 promotes the creation of overspin as it brushes upward on the ball.

As described above, the putter head 10 includes a hosel cavity 120 which receives the hosel 50 for connecting the shaft 60 of the putter with the putter head 10. The hosel cavity 120 has a hosel opening 122, which is shaped to receive the hosel 50. As shown in the exemplary embodiment of FIG. 1, the shaft 60 extends from the top surface 160 of the putter head 10 at an angle. As such, when the golfer holds the shaft 60 at a shaft handle at the other end of the putter head 10, the shaft 60 extends away from the golfer at an angle to position the putter head 10 a distance from the golfer.

Figure 6:
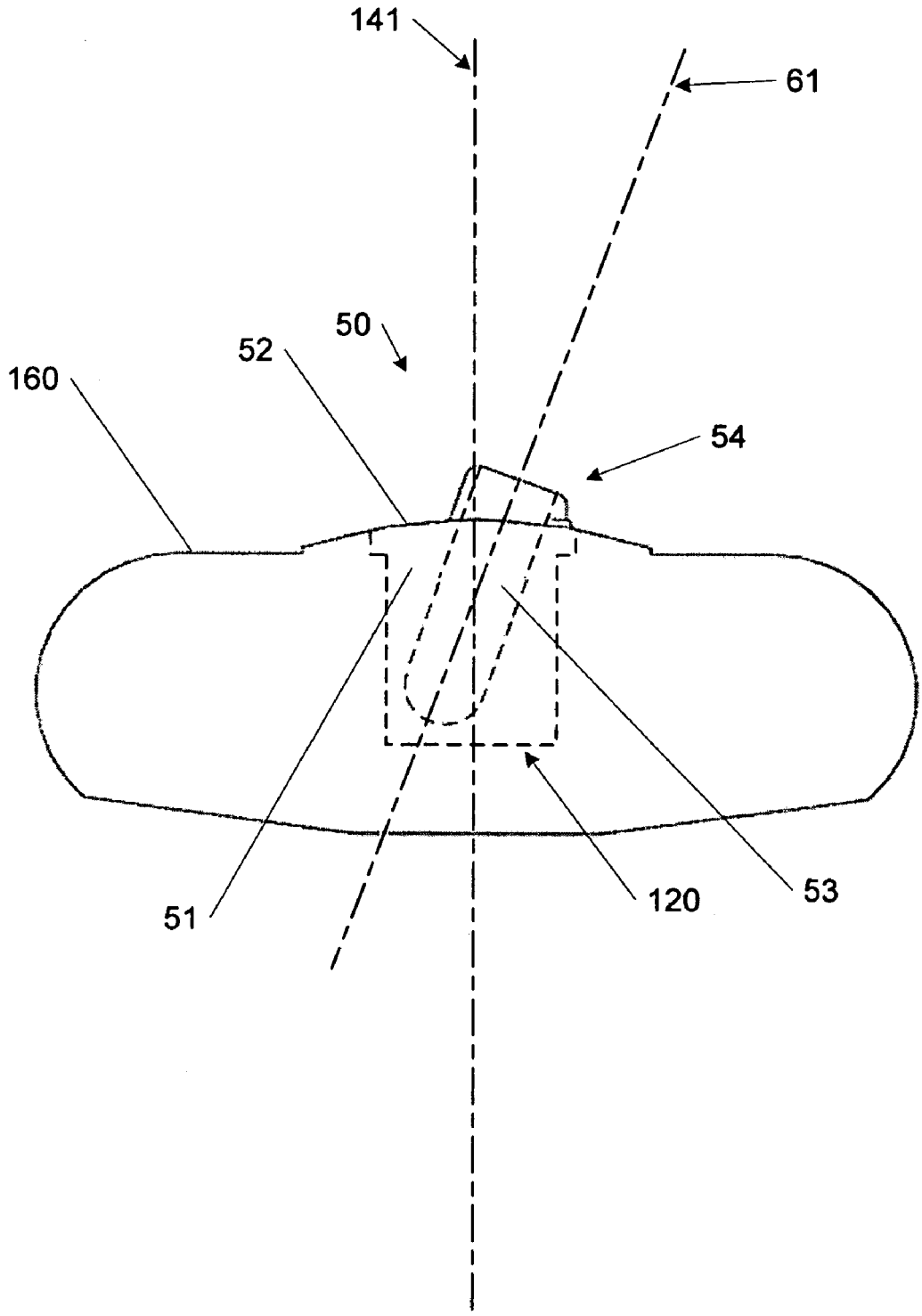
FIG. 6 illustrates the hosel used with the putter head for the exemplary golf putter illustrated in FIG. 1.

As shown in the putter head of FIG. 6, the hosel 50 has a block 51 and a shaft cavity 53. The shaft 60 is received into the shaft cavity 53. The block 51 has a top surface 52. When the hosel 50 is received into the hosel cavity 120, the top surface 52 is generally oriented with the top surface 160 of the putter head 10. The shaft cavity 53 has a shaft cavity opening 54 which is angled with respect to the top surface 52 of the block 51. Thus, the shaft cavity opening 54 is also angled with respect to the top surface 160 of the putter head when the hosel 50 is positioned in the hosel cavity 120. Accordingly, when the shaft 60 is inserted through the angled shaft cavity opening 54, the shaft 60 extends from the putter head 10 at an angle.

Due to the angle between the shaft 60 and the putter head 10, two different shaft orientations are required to accommodate both right-handed and left-handed golfers. For instance, when the ball-striking face 140 is viewed directly, the shaft 60 is angled to the right to accommodate a right-handed golfer, as shown in FIG. 6. On the other hand, the shaft 60 is angled to the left to accommodate a, left-handed golfer, as shown in FIG. 1. Accordingly, with embodiments of the present invention, the hosel 50 is easily positioned in the hosel cavity 120 with two different orientations to permit the shaft 60 to be angled in two different directions. Furthermore, the hosel cavity 120 and the hosel block 51 may be shaped to ensure that the hosel 50 is only positioned in one of the two appropriate orientations. For instance, the hosel cavity 120 and hosel block 51 may have corresponding oblong shapes, as shown in FIG. 3. The hosel 50 may be made from various materials, including but not limited to the metals used for the shell 100, a plastic, or a composite. In order to fix the hosel 50 in the hosel cavity 120, an epoxy, adhesive, bonding agent, or any known fastening technique, such as screws or interlocking pieces, may be employed. The shaft 60 may be fixed in shaft cavity 53 by similar techniques.

In order to provide the golfer with appropriate "touch and feel," the putter 5 provides feedback through the shaft 60 when the putter head 10 strikes the ball. To achieve this "touch and feel," the shaft 60 intersects the horizontal and vertical planes generally transverse to the ball-striking face 140 that intersect the point where the ball-striking face 140 is generally expected to contact the ball. As shown in FIG. 6, the centerline 61 of the shaft 60 is offset from plane containing the front centerline 141 and the top centerline 161 when the shaft 60 intersects the top surface 160, but the shaft 60 extends at an angle to intersects this plane at the height from the bottom surface 260 where the ball-striking face 140 is expected to contact the ball.

Although the embodiments described heretofore receive the hosel 50 in hosel cavity 12, it is understood that the present invention is not limited to this preferred technique of attaching the shaft 60 to the putter head 10. For instance, a hosel, which connects the shaft to the putter head, can be attached to the top surface of the putter head without requiring a cavity that extends into the putter head. Moreover, it is also understood that the shaft 60 may extend from the putter head 10 at various angles, or may even extend perpendicularly from the putter head 10 which eliminates the need for right and left-handed hosel orientations.

To aid the golfer in the use of putter 5, the putter head 10 may have an alignment system 70, as shown in FIG. 1. The alignment system 70 employs a marking 71 on the top surface 160 visible to the golfer using the putter 5. The marking 71 extends along the centerline 161, from the ball-striking face 140 to the rear end 190. In general, the putter head 10 strikes the ball along the centerline 161. As such, the marking 71 is placed on the top surface of the end body 180 and around the hosel opening 122. The marking 71 may be painted onto these areas with a highly visible paint that contrasts with the rest of the putter head 10 and the conventional putting environment. In particular, white paint may be used to create the marking 71. To enhance the contrast, the rest of the putter head 10 can have a dark color, such as black. Furthermore, the area around the hosel cavity 120 and the top surface of the end body 180 may be elevated over the shell shoulders 170 to enhance the marking 71. As a result, a golfer can easily determine the line that the putter head 10 will follow when the golfer swings the putter 5, and therefore can align the swing of the putter 5 with thee line that the golfer wants the ball to follow. The marking 71 is prominent to facilitate alignment and to permit the golfer to see the marking 71 peripherally while focusing on the ball during the putting stroke. A logo or brand marking may be placed on the marking 71, but may not be so prominent as to distort the necessary visual effect of the alignment system.

Accordingly, in view of the foregoing, the present invention provides a unique putter with at least two, or preferably three, radii of curvature to promote the creation of overspin on a putted golf ball and to minimize the inaccuracies caused by backspin and airborne movement seen in conventionally putted golf balls. Additionally, the present invention combines the radii of curvature with a center-of-mass that is positioned closer to the top surface and the rear end of the putter head to promote further creation of overspin.

Organizations, such as the United States Golf Association (USGA), issue very specific rules governing the design of golf equipment. Golfers competing in sanctioned events must use equipment that conforms to these rules. It is understood that embodiments of the present invention, however, may or may not conform with such regulations.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. A golf putter head, comprising:

a body with a ball-striking face including a first curved segment with a first radius of curvature and a second curved segment with a second radius of curvature, the first and second curved segments defining a curved surface extending from a bottom surface of the body, the first segment being positioned proximate to the bottom surface, the second segment being positioned intermediate the bottom surface and an opposing top surface of the body, and the first radius of curvature being greater than the second radius of curvature, wherein the ball-striking face further comprises a third curved segment with a third radius of curvature, the first, second, and third curved segments defining a curved surface extending from the bottom surface of the body to the top surface of the body, the third segment being positioned intermediate the second segment and the top surface, and the third radius of curvature being greater than the first radius of curvature.

2. The golf putter head according to claim 1, wherein the first radius of curvature is between 2 inches and 6 inches, and the second radius of curvature is less than 2 inches.

3. The golf putter head according to claim 1, wherein the first radius of curvature is between 2 inches and 6 inches, the second radius of curvature is less than 2 inches, and the third radius of curvature is greater than 6 inches.

4. The golf putter head according to claim 1, wherein the first curved segment and the second curved segment form a first intermediate boundary, and the second curved segment and third curved segment form a second intermediate boundary.

5. The golf putter head according to claim 4, wherein the first intermediate boundary is positioned about 1.1 to 1.2 inches from the bottom surface of the body, and the second intermediate boundary is positioned about 0.75 to 0.85 inches from the bottom surface.

6. The golf putter head according to claim 1, wherein the ball-striking face and the bottom surface form an angle greater than 90 degrees.

7. A golf putter head according to claim 1, wherein the body further comprises a rear portion extending from the ball-striking face to a rear end of the putter head opposite the ball-striking face, the rear portion having greater mass closer to the rear end of the putter head than the ball-striking face.

8. The golf putter head according to claim 7, wherein one of the three curved segments protrudes in relation to the other of the at least three curved segments to form a contact area.

9. The golf putter head according to claim 7, wherein the center of mass for the putter head is closer to the rear end than the ball-striking surface.

10. The golf putter head according to claim 7, wherein the rear portion has greater mass closer to the top surface than the bottom surface.

11. The golf putter head according to claim 10, wherein the center of mass for the putter head is closer to the rear end than the ball-striking surface and closer to the top surface than the bottom surface.

12. The golf putter head according to claim 7, wherein the ball-striking face has a width greater than the rear end.

13. The golf putter head according to claim 12, wherein the rear portion tapers from the ball-striking face to a smaller dimension at the rear end.

14. The golf putter head according to claim 13, wherein the rear portion comprises two shoulders extending from the ball-striking face and forming two sides of the rear portion.

15. The golf putter head according to claim 7, wherein the ball-striking face and the rear portion are symmetric about a plane passing through a top centerline of the top surface and a front centerline of the ball-striking face.

16. The golf putter head according to claim 7, wherein the body has a mass between about 360 grams and 425 grams.

17. The golf putter head according to claim 7, wherein the rear portion comprises a hosel cavity receiving a hosel at the top surface, the hosel cavity extending into the rear portion proximate to the ball striking surface.

18. The golf putter head according to claim 17, wherein the hosel is inserted into the hosel cavity according to one of two orientations coffesponding to attachment of a putter shaft for right-handed use and left-handed use, respectively.

19. The golf putter head according to claim 18, wherein the hosel and the hosel cavity are colTespondingly oblong.

20. The golf putter head according to claim 17, wherein the hosel comprises a shaft cavity for receiving a putter shaft, the shaft cavity intersecting a plane passing through a contact area on the ball-striking face.

21. The golf putter head according to claim 7, further comprising an alignment marking on the top surface of the body.

22. A golf putter head according to claim 1, wherein the body further comprises:

a shell of a first material having a shell cavity, the shell including the ball-striking face; and a filler of a second material positioned in the shell cavity.

23. The golf putter head according to claim 22, wherein one of the three curved segments protrudes in relation to the other of the at least thee curved segments to form a contact area.

24. The golf putter head according to claim 22, wherein the second material has a lower density than the first material.

25. The golf putter head according to claim 22, wherein the shell has an opening to the shell cavity at the bottom surface of the head.

26. The golf putter head according to claim 25, wherein the filler forms substantially the entire bottom surface of the head.

27. The golf putter head according to claim 22, further comprising an outer cover of a third material forming at least a portion of an outer surface of the head.

28. The golf putter head according to claim 27, wherein the third material comprises a plastic.

29. The golf putter head according to claim 22, wherein the shell comprises an end body extending from the ball-striking face and forming a rear end opposite the ball-striking face.

30. The golf putter head according to claim 29, wherein the shell further comprises a shoulder on each side of the end body, and the shoulders define a tapered shape for the head from the ball-striking face to a smaller dimension at the rear end.

31. The golf putter head according to claim 30, wherein the ball-striking face, the end body, and the shoulders define the shape of the shell cavity.

32. The golf putter head according to claim 31, wherein a wall of the shell is thickest proximate to the rear end.

33. The golf putter head according to claim 32, wherein the wall is thickest proximate to the rear end and the top surface.

34. The golf putter head according to claim 31, wherein the shell cavity has a volume that is greater proximate to the ball-striking face than the rear end.

35. The golf putter head according to claim 31, wherein the shell further comprises a hosel cavity receiving a hosel proximate to the ball striking face, the hosel cavity extending into the shell from the top surface and further defining the shell cavity.

36. The golf putter head according to claim 35, wherein the hosel cavity is symmetric about a centerline of the top surface passing through the ball-striking face.

37. The golf putter head according to claim 35, wherein the hosel is inserted into the hosel cavity according to one of two orientations coffesponding to attachment of a shaft for right-handed use and left-handed use, respectively.

38. The golf putter according to claim 37, wherein the hosel and hosel cavity are correspondingly oblong.

39. The golf putter head according to claim 35, wherein the hosel comprises a shaft cavity for receiving a putter shaft, the shell cavity intersecting a plane passing through a contact area on the ball-striking face.

40. The golf putter head according to claim 22, wherein the putter head has a mass between about 360 grams and 425 grams.

41. The golf putter according to claim 22, further comprising an alignment marking on the top surface.

42. The golf putter head according to claim 22, wherein the first material comprises one of zinc, aluminum, titanium, and steel.

43. The golf putter head according to claim 22, wherein the second material comprises a plastic.

* * * * *